US005249892A

United States Patent [19]

Fox et al.

[11] Patent Number: 5,249,892

[45] Date of Patent: Oct. 5, 1993

[54] SHORT AGGREGATE PIERS AND METHOD AND APPARATUS FOR PRODUCING SAME

[76] Inventors: Nathaniel S. Fox, 4635 Riveredge Cove, Lithonia, Ga. 30058; Evert C. Lawton, 7955 SW. 198 Terrace, Miami, Fla. 33189

[21] Appl. No.: 672,701

[22] Filed: Mar. 20, 1991

[51] Int. Cl.[5] ..... E02D 3/12; E02D 5/46

[52] U.S. Cl. ..... 405/233; 404/133.1; 405/229; 405/271

[58] Field of Search ..... 405/237, 233, 239, 240, 405/271, 258; 404/133.05, 133.1, 133.2

[56] References Cited

U.S. PATENT DOCUMENTS

| | | | |
|---|---|---|---|
| 947,548 | 1/1910 | Lind | 404/133.1 |
| 1,764,948 | 6/1930 | Frankignoul | 405/237 |
| 2,917,979 | 12/1959 | Dening et al. | 404/133.1 |
| 3,073,124 | 1/1963 | Nadal | 405/237 X |
| 3,256,790 | 6/1966 | Hoppenrath | 404/133.05 X |
| 3,909,149 | 9/1975 | Century | 404/133.2 |

FOREIGN PATENT DOCUMENTS

| | | | |
|---|---|---|---|
| 616470 | 10/1926 | France | 405/237 |
| 565012 | 7/1957 | Italy | 405/237 |
| 369816 | 3/1932 | United Kingdom | 405/237 |

*Primary Examiner*—Dennis L. Taylor
*Attorney, Agent, or Firm*—Hopkins & Thomas

[57] ABSTRACT

A method and apparatus for producing short aggregate piers in situ in the ground including the steps of forming a cavity in the ground, compacting soil in the vicinity of a bottom portion of the cavity to prestress and densify the soil beneath the cavity, adding a layer of loose aggregate to partially fill the cavity, compacting the layer of loose aggregate with an implement 10 adapted to reduce the height of the layer and adapted to prestress and densify the soil laterally by forcing some of the aggregate laterally into the sides of the cavity and thereby also enlarging the cavity in the vicinity of the layer, and repeating steps of adding aggregate and compacting aggregate until the cavity is filled substantially completely with compacted aggregate or is filled to the desired elevation. The resulting pier has a bulging, undulating outer surface which the surrounding prestressed soil is better able to support.

11 Claims, 5 Drawing Sheets

SHORT AGGREGATE PIERS AND METHOD AND APPARATUS FOR PRODUCING SAME

TECHNICAL FIELD

The present invention relates to strengthening of soil of otherwise inadequate load-bearing capacity by the formation therein of short aggregate piers.

BACKGROUND OF THE INVENTION

In current civil engineering and building construction practice, many structures ranging from residential houses to high-rise buildings are founded on deep foundation systems, such as piles or drilled piers, which extend to rock or stronger soils to support the building. This is often necessary because soils near the surface frequently are inadequate for supporting the building upon a shallow foundation. These deep foundations tend to be rather expensive compared to shallow foundations and are typically necessary where the near-surface soils include soft to stiff clays, silts, sandy silts, loose to firm silty sands and sands. In most shallow foundations, the amount of settlement tolerable (influenced by the soil's compressibility) controls the usefulness of the shallow foundation, rather than the ultimate load-bearing capacity (strength). For some situations where the near-surface soils are inadequate or marginal for supporting shallow foundations, the in situ soils can be stiffened with reinforcement, such as short aggregate piers. This allows shallow foundations to be used in place of deep foundations or smaller footings to be used in circumstances where space limitations are critical. In either instance, a substantial cost savings can be realized using short aggregate piers to reinforce the near-surface soils.

Similar improvements in subgrade, subbase and base materials beneath highways, railroads, and runways can result in substantial savings in construction costs. For example, in most highways that are built in non-fill soil sites, the in situ soil is incapable of adequately supporting a thin pavement wearing surface. The traditional solution is to excavate the existing soil to a certain depth, usually between four (4) and twenty-four (24) inches and replace the removed material with a material having greater load-bearing capabilities in a combination of compacted subbase and base layers. As an alternative, the thickness of the wearing surface can be increased to reduce potential damage from traffic caused by the poor load-bearing characteristics of the subgrade soil. In either event, a substantial cost is associated with the excavation and replacement or with the increased thickness of the wearing surface.

There are two well-known methods for producing a type of deep soil reinforcement known commonly as "stone columns" in situ to strengthen soft soils. These two methods are the so-called "vibro-replacement" and the "vibro-displacement" methods. These methods have been successfully used in numerous major projects in which the in situ soil was primarily soft clay. Each of these methods produces an improvement in the load-bearing capability of the ground, rather than producing a piling resting on bedrock, although stone columns are relatively deep and are often extended to stronger subsoils or even to bedrock.

The vibro-replacement technique (also known as the "wet method") involves jetting a hole into the ground to a desired depth using a vibratory probe (Vibroflot). The jetting is normally accomplished by forcing liquid under great pressure through a lower end of the probe to loosen and cut the soil and by forcing the probe downwardly into the ground. The uncased hole is then flushed out and, typically, uniform graded stone (stone which has been graded to have a relatively uniform particle size) is placed in the bottom of the hole in increments and is compacted by raising and lowering the probe, while at the same time vibrating the probe. The vibro-replacement method is characterized by relatively high cost owing to the rather heavy and specialized nature of the equipment necessary to carry out the method. This has tended to limit the use of the method to relatively large and expensive projects. Also, this technique can have a negative impact on the local environment due to the large quantities of water that are typically used in the process. This causes difficulties in disposing of the excess water and typically results in pools of standing water collected near the constructed columns. These pools of water can impede construction efforts at the site, and add additional cost to the construction.

The second of the above-identified common methods of producing relatively deep stone columns in the ground is known as the "vibro-displacement" or dry method. In the vibro-displacement method, a vibratory probe is forced downwardly into the ground, displacing soil by compaction downwardly and laterally. Compressed air is forced through the tip of the probe to ease penetration into the ground. Once the probe has reached the desired depth, which typically is 20 to 50 feet, the probe is withdrawn and backfill is added to the hole, the backfill typically being drawn from the site itself. The backfill is then compacted using the probe. Several iterations of the filling and compacting steps typically are required to produce a deep stone column having improved load-bearing characteristics as compared with the naturally occurring surrounding soil. The vibro-displacement method also suffers from requiring heavy specialized construction equipment and is generally best suited for improving firmer soils that have a deep groundwater table.

Each of the above-described methods for creating deep stone columns or granular columns, and other known techniques for producing stone or granular columns in relatively soft soils, generally fails to fully exploit the increased load-bearing capacity of the soil surrounding the stone columns if the soil were to be significantly prestressed and densified, as by high energy lateral impact stress. This failure to laterally prestress or compact the surrounding soil to a significant degree is noteworthy because such stone or granular columns are cohesionless, and while being stiffer than the surrounding soil, the columns derive much of their load-bearing capability from the surrounding lateral soil.

Accordingly, it can be seen that a need yet remains for a method of producing reinforcing elements in situ in soils wherein the surrounding lateral soil adjacent the resulting reinforcing elements are significantly prestressed and compacted to improve the load-bearing capability of the reinforcing element, while at the same time being capable of being carried out with relatively inexpensive and simple equipment. It is the provision of such a method, and the reinforcing elements that result therefrom, that the present invention is primarily directed.

SUMMARY OF THE INVENTION

Briefly described, in a preferred form the present invention comprises a method for producing short aggregate piers in situ in the ground. The method includes the steps of forming a cavity in the ground, compacting soil in the vicinity of a bottom portion of the cavity to prestress and densify the soil in that vicinity, adding a layer of loose well-graded aggregate to partially fill the cavity, compacting the layer of loose aggregate with an implement adapted to reduce the height of the layer of aggregate and to force some of the aggregate laterally into the sides of the cavity to induce high-intensity lateral stresses in the adjacent soil and to enlarge the cavity in the vicinity of the layer, and repeating the steps of adding loose aggregate and compacting the loose aggregate until the cavity is filled substantially completely to the desired elevation with the layers of densely compacted aggregate. Preferably, the aggregate used is well-graded stone, and the implement used to compact the stone is flat bottomed with an angled or curved peripheral rim adapted to impart high-level lateral force for pushing the aggregate and the adjacent soil laterally as the aggregate and adjacent soil are compacted.

With this method, as each layer of loose aggregate is compacted the cavity expands or bulges in the vicinity of that layer. The resulting aggregate/soil interface is generally undulated in the manner of a series of bulges stacked one upon another. This causes the soil laterally surrounding the reinforcing element to be prestressed and densified to a significant degree. Because much of the load-bearing capability of the element (pier) derives from the surrounding soil, a pier of a given size according to the present invention is able to carry a significantly greater load. In effect, by prestressing and densifying the surrounding soil to a significant extent, while simultaneously constructing an undulating aggregate/soil interface, the effective size and support capacity of the resulting pier is significantly increased.

This method, in addition to the load-bearing advantages, has the added advantage of being carried out with relatively simple and inexpensive equipment. This is because the technique does not require the use of large specialized vibratory probes, as necessitated by the currently known methods of producing deep stone columns. Indeed, the hole or cavity can be prepared with any number of conventional techniques, the preferred method being to drill the hole and excavate the soil using an auger.

In another form, the present invention comprises a tamper apparatus for compacting layers of loose aggregate placed within a cavity in soil for producing reinforcing elements in situ. The apparatus comprises a support member having a lower end and a tamping head mounted to the lower end including a tapered portion adapted to displace some of the aggregate laterally into the sides of the cavity and thereby to prestress and densify the adjacent soil by inducing high intensity lateral stresses within it. A further result is that the cavity is enlarged laterally adjacent the layer of aggregate being compacted. Preferably, the tapered portion of the tamper apparatus is frusto-conical in shape and has a substantially flat bottom surface.

In another form the invention comprises a composite soil matrix with improved load-bearing characteristics including a short aggregate pier constructed in situ in a bed of soil. The aggregate pier includes a series of radial bulges situated along the length of the pier. The bed of soil and the aggregate pier together define a first pier/soil interface zone below the aggregate pier and a second pier/soil interface zone laterally adjacent the aggregate pier. The soils in the first and second interface zones are prestressed to a significant amount and densified to improve the ability of the soil bed to support the short aggregate pier.

In another embodiment, the present invention comprises a method for preparing a soil for receiving a layer of pavement. The method includes the steps of pricking the ground with ganged members to form a plurality of cavities in the soil, adding a layer of loose granular material to partially fill the cavities, compacting the layer of granular material in each of the cavities with the ganged members, and repeating the steps of adding granular material and compacting the granular material until the cavities are filled substantially completely with compacted granular material. The cavities may also be formed with ganged members of drill auger segments. The ganged members used for compacting the layer of granular material each have a tapered portion adapted to compact the granular material both vertically and laterally and thereby to induce high-intensity lateral stresses in the soil adjacent to the layer of aggregate. These lateral stresses prestress the soil while simultaneously densifying it. Preferably, the ganged members are regularly spaced in a grid pattern and are generally cylindrical in shape with diameters preferably of between one (1) inch and six (6) inches.

Accordingly, it is an object of the present invention to provide a method for producing a reinforcing element or elements in situ in the ground which is efficient and effective for producing a reinforcing element or elements of suitable strength.

Another object of the present invention is to provide a method for producing in situ in the ground a dense, short aggregate pier which can be carried out using relatively simple and inexpensive equipment.

Another object of the present invention is to provide a method for producing in situ in the ground a short aggregate pier wherein the soil laterally surrounding the aggregate pier is significantly densified and prestressed to provide a strong column.

Another object of the present invention is to provide a method for producing in situ in the ground a short aggregate pier without substantial negative environmental impact, for example, without generating excess water disposal problems.

Another object of the present invention is to provide an economical method for producing in situ in the ground a short aggregate pier which is suitable for soft or loose soils, as well as for moderate strength soils.

Other objects, features, and advantages of the present invention will become apparent upon reading the following specification in conjunction with the accompanying drawing figures.

DETAILED DESCRIPTION

Figure 1:
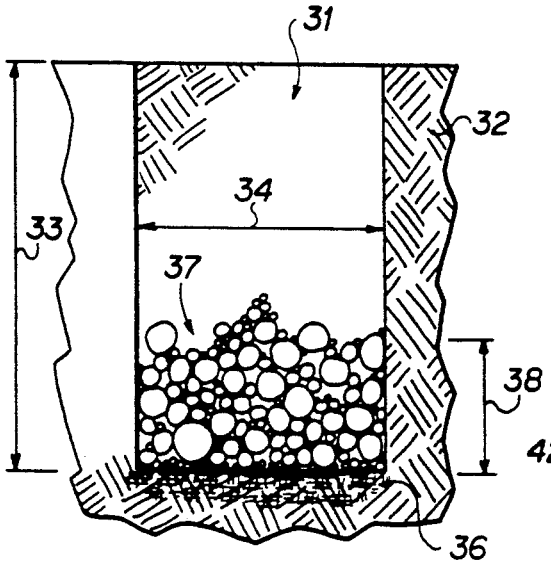
FIGS. 1–3 are schematic illustrations of steps according to the method of the present invention for creating short aggregate piers in situ in the ground, and showing a portion of an apparatus used for carrying out the method.
Figure 2:
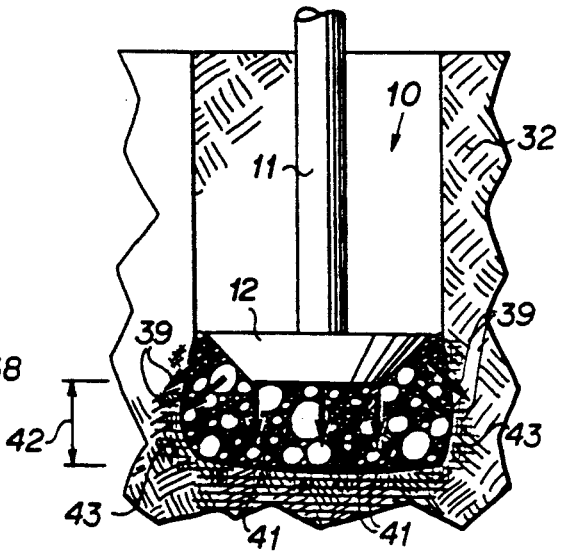
Figure 3:
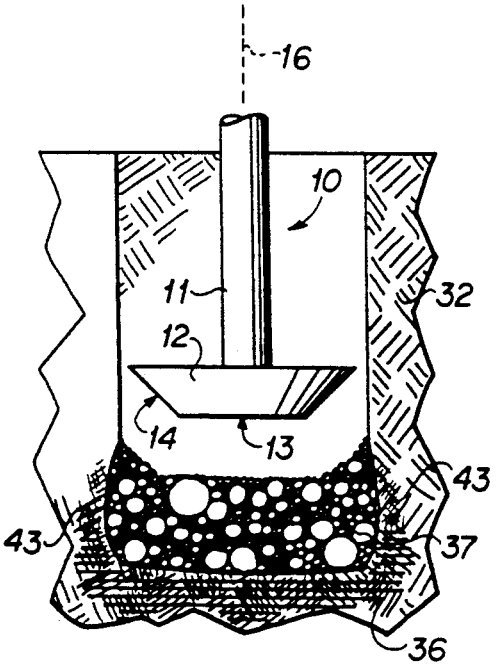

Referring now in detail to the drawings, in which like reference numerals represent like parts throughout the several views, FIGS. 1–3 depict a method and apparatus for constructing short aggregate piers according to a preferred form of the invention. As shown in FIGS. 2 and 3, a tamper apparatus 10 for constructing short aggregate piers includes an elongated support shaft 11 and a tamping head 12. The tamper apparatus can be driven downwardly in any of a number of well-known, high-intensity techniques, such as for example being connected to a piston of a hydraulic ram and forced downwardly. Also, the support shaft can be struck with a falling weight to drive the tamping head downwardly, or can be driven by a pneumatic hammer.

The tamping head 12 includes a generally flat, blunt bottom face indicated at 13 and a tapered surface indicated at 14. The flat bottom face 13 is adapted for compacting soil and aggregate fill in a vertical direction, while the tapered surface 14 is frusto-conical for tamping soil at a 45° angle, or other suitable angle, with respect to a vertical axis 16 extending through the support shaft 11.

Figure 4:
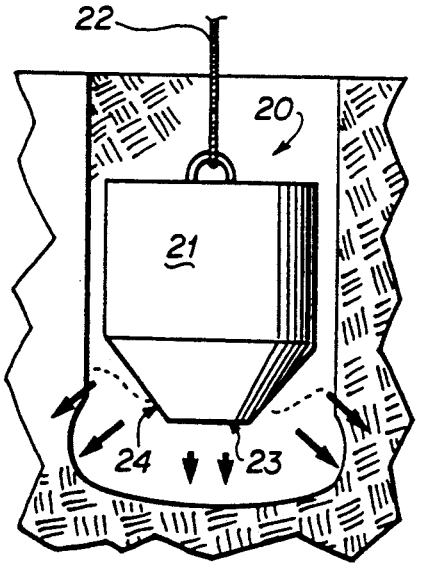
FIG. 4 is a schematic illustration of an alternative apparatus for carrying out the method of FIGS. 1–3.

FIG. 4 shows an alternative embodiment of a tamper apparatus, specifically apparatus 20. In this alternative embodiment, the tamper apparatus has a rather substantial and weighty body portion 21 which is lifted with a rope or chain or cable 22 and dropped or forced downwardly. Despite the different technique for raising and lowering the tamper apparatus 20, the tamper apparatus 20 shares important features with tamper apparatus 10. Namely, tamper apparatus 20 either includes a flat bottom surface 23 and a frusto-conical surface 24, or a spherical or near-spherical bottom surface.

Having now described the physical structure of two embodiments of a tamping apparatus useful for constructing in situ short aggregate piers according to the present invention, attention is now turned to the use of the tamping apparatus to construct such piers. FIG. 1 shows a hole or cavity 31 which has been formed in an existing soil 32. The hole or cavity 31 can be formed by any number of well-known techniques. For example, the cavity can be formed by use of an auger or by driving a mandrel, having a plow point at its lower end, into the ground. The cavity is excavated to a depth 33 and to a diameter 34. The depth 33 and the diameter 34 of the cavity are substantially the nominal dimensions of the ultimate short aggregate pier to be constructed, although the depth 33 may be increased by 12 inches or more by vertical compaction of the soil at the bottom of the cavity prior to placing the first layer of aggregate fill. It should be noted that in considering the present invention, the cavity will be discussed as having a round cross-section and, therefore, having a diameter. However, other shapes of cavities can be constructed as the particular application requires. Indeed, it is contemplated by the present invention that elongated walls can be constructed according to the present invention. Nonetheless, for purposes of illustrating the invention, discussion will be limited to cylindrical piers.

With the cavity 31 thus excavated, the first step according to the invention is to compact the soil at the bottom of the cavity to densify the soil directly beneath the bottom of the cavity. Compaction of the soil lining the bottom of the cavity is beneficial and increases the support capacity of the short aggregate pier. The result is a zone of prestressed and densified soil 36 adjacent and beneath the bottom of the cavity 31.

The next step is to fill a portion of the cavity 31 with a quantity of loose, well-graded aggregate generally indicated at 37 in FIG. 1. Other granular material besides loose, well-graded aggregate can be used as the particular application requires. Well-graded aggregate is preferred because of the substantial strength imparted by the larger particles in the well-graded aggregate, with the smaller particles acting to fill the interstices between the larger particles quite effectively. The aggregate 37 is added to a depth 38 to create an uncompacted layer. The depth 38 preferably is eighteen (18) inches, but can be between six (6) inches and three (3) feet.

With a layer of aggregate partially filling a bottom portion of the cavity, the next step is to compact the aggregate with the tamping apparatus 10 to highly densify the aggregate and to induce high-intensity lateral stresses in the soil laterally surrounding the cavity in the vicinity of the layer 37 of aggregate. These lateral stresses prestress the soil while simultaneously densifying it. As shown in FIG. 2, the forces exerted on the aggregate and thereby on the surrounding soil, being tamped by operation of the tamping apparatus 10 tend to be normal to the surfaces of the tamping apparatus. Thus, the forces exerted by the flat bottom portion 13 tend to compress the aggregate vertically primarily, while the forces exerted on the aggregate by the frusto-conically tapered surface 14 on the aggregate have both a vertical and a lateral component. Indeed, since the frusto-conical surface is at an approximate 45° angle with respect to axis 16, which axis is co-incident with the axis of travel of the tamper apparatus in use, the magnitude of the lateral component of forces exerted on the aggregate by the conically-tapered surface is equal to the magnitude of the vertical component of the force exerted on the aggregate. The resultant force of the lateral and vertical components exerted on the aggregate by the conically-tapered surface 14 is depicted in FIG. 2 by force arrows 39. Force arrows 41 depict the vertical forces exerted by the bottom surface 13 acting on the aggregate 37. By operation of the tamping apparatus 10, the height 38 of the aggregate layer 37 is reduced significantly. For example, the preferred uncompacted layer of aggregate would have initial height of eighteen (18) inches and after compaction would have a compacted height 42 which is some one-third less than the uncompacted height 38, in this case compacted height would be twelve (12) inches.

Since the aggregate layer 37 is made up of a large number of granular elements which are able to move about relative to each other under pressure, the downward force 41 exerted by the bottom surface 13 of the tamping apparatus causes some outward pressure on the sidewalls of the cavity. This outward pressure on the sidewalls of the cavity is greatly augmented by the horizontal components of forces 39, caused by the tapered surface 14 acting on the aggregate layer 37. Indeed, the aggregate 37 bulges to a significant extent as indicated schematically in FIGS. 2, 3 and 5. The lateral component of the forces 39 which causes the cavity to bulge also places great prestress on the soil 32 in the vicinity of the now-compacted layer 37 of aggregate. Indeed, the soil in a zone indicated at 43 positioned laterally of the soil/aggregate interface is compacted and prestressed to a significant degree. The now-bulged layer or lift 37 of compacted aggregate is complete.

The tamping apparatus 10 is then withdrawn from the cavity 31 and an additional layer of uncompacted, loose aggregate is added atop the compacted layer to an additional depth of, for example, eighteen (18) inches. The new layer of loose aggregate is then similarly compacted to the reduced height of, for example, twelve (12) inches. This process is repeated until a series of bulged layers extends from the bottom of the cavity and completely fills the cavity as shown in FIG. 5, or fills the cavity to an extent desired.

Figure 5:
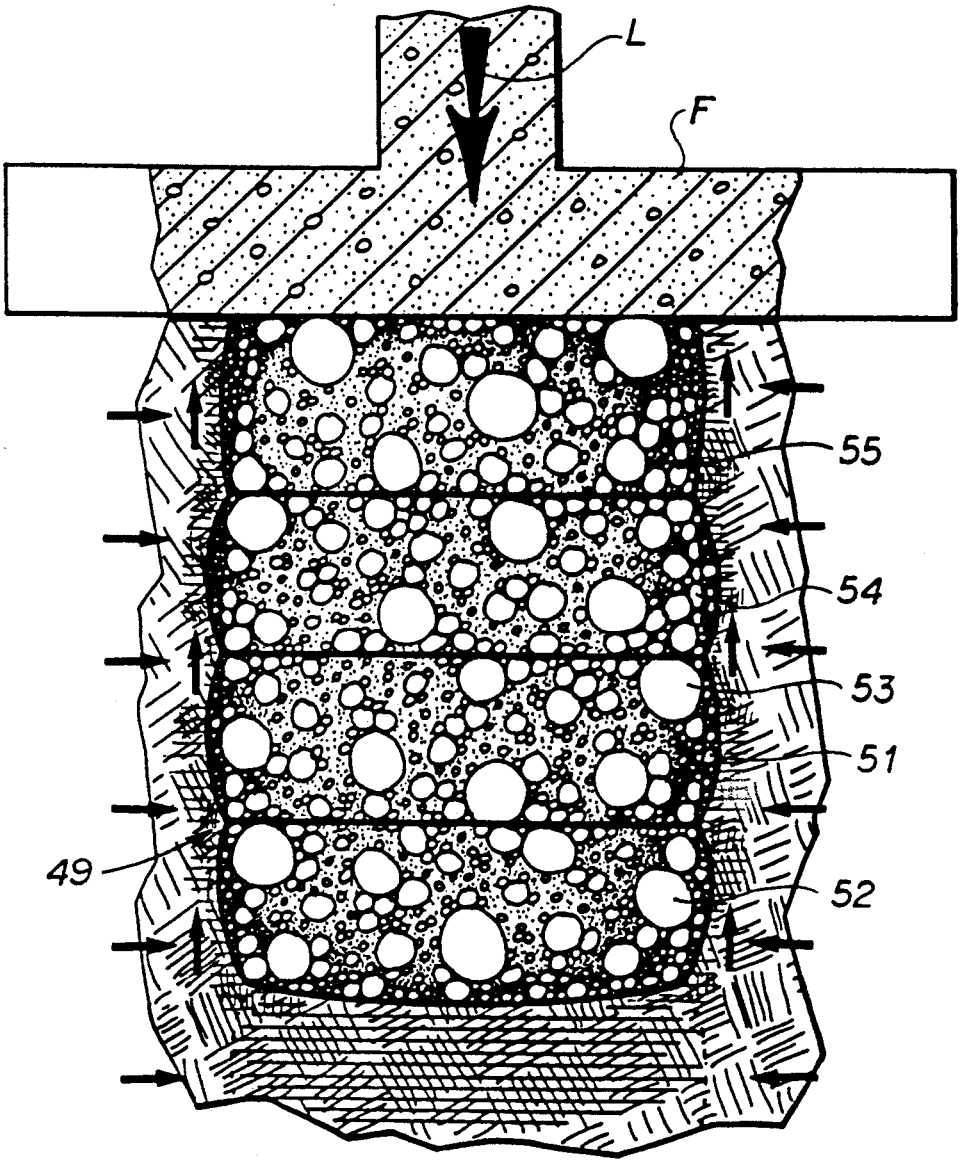
FIG. 5 is a side sectional illustration of a short aggregate pier produced in situ in the ground according to the present invention and supporting a structure thereon.

As shown in FIG. 5, the short aggregate pier 51 is generally cylindrical in overall shape, but having a series of bulges extending along its length. Aggregate pier 51, for example, comprises first, second, third and fourth lifts or layers 52–55. Each of these layers has a generally bulged shape. The resulting overall external surface has a greater surface area than a conventional deep stone column of the same nominal diameter having a cylindrical structure. This has important advantages as is discussed below. Also, by virtue of the construction of these bulges during compaction of the aggregate pier, the surrounding soil is prestressed and densified to a significant degree in the zone laterally adjacent the aggregate pier. This prestressing and densification of the surrounding soil is also very important and will be discussed in more detail below. FIG. 5 also shows that the aggregate pier 51 can be used to support a footer F for bearing the load of a building structure indicated by the force arrow labelled L.

Figure 6:
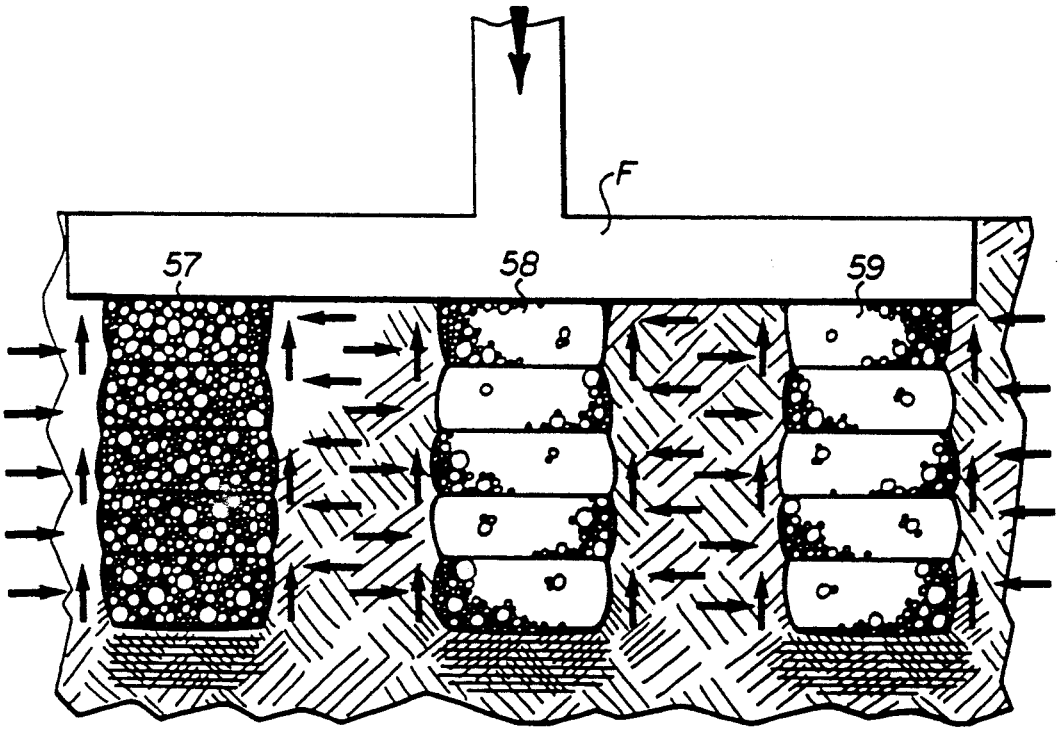
FIG. 6 is a side sectional view of several short aggregate piers produced in situ in the ground according to the present invention and supporting a structure thereon.

FIG. 6 shows a number of short aggregate piers constructed in situ in the ground and cooperating to support a footer F. While three aggregate piers 57–59 are shown in FIG. 6, any number of such piers can be used as the particular application requires.

FIELD TESTS

The applicants conducted two field studies related to the above-described invention. The preliminary field studies were conducted to evaluate the viability of using short aggregate piers to reinforce soils beneath shallow building foundations. Well-graded, aggregate base coarse stone was used in both field studies as the backfill material to make up the aggregate piers.

In the first field study, a 24-inch diameter field plate-load test was performed on each of three short aggregate piers constructed in situ in soil consisting primarily of firm sandy micaceous silts and construction debris which had been placed as an uncontrolled fill. Standard penetration blow counts of the near-surface matrix soil ranged from six to ten blows per foot and averaged eight blows per foot. Two of the three test piers were compacted by dropping a cylindrical weight with a tapered bottom from a tripod. The tapered bottom induced high-intensity lateral stresses on the surrounding soil. These stresses prestressed and densified the laterally surrounding soil.

In the third test, the aggregate was dumped into the cavity but was not compacted.

Reactions for the loading tests were provided by jacking against the rear axle of a 10-ton truck loaded with weight. The maximum applied load using this method was 12 kips, which was insufficient to cause failure of the aggregate piers, but which was large enough to test the piers substantially above the design load of 2.5 ksf.

Figure 10:
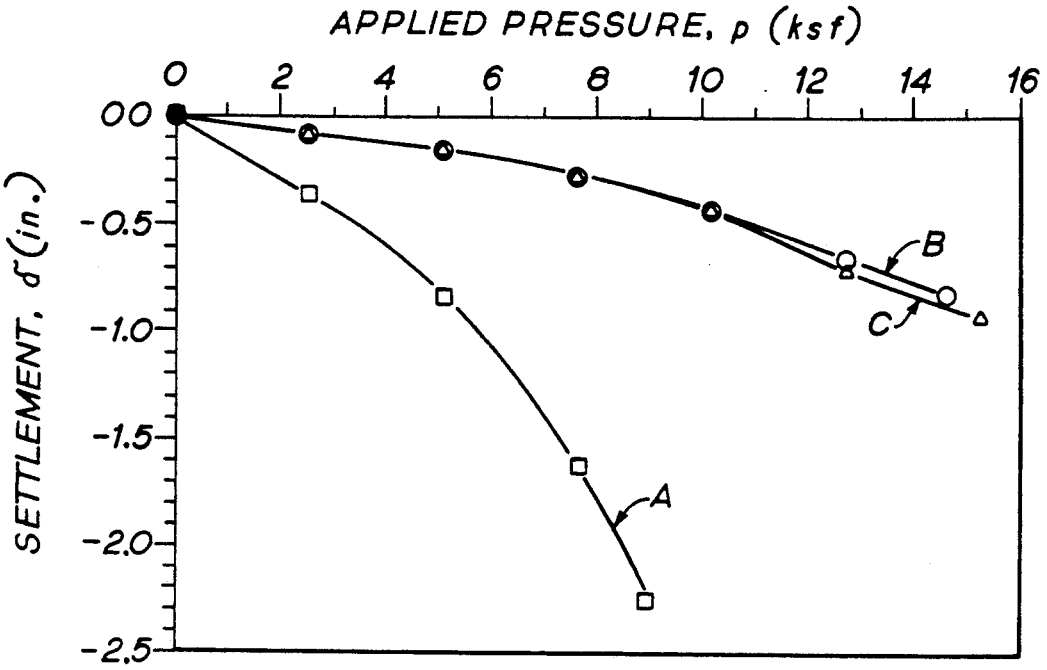
FIGS. 10 and 11 are graphs showing the results of field tests conducted to evaluate the present invention.

The pressure-settlement curves from these three plate-load tests are illustrated in FIG. 10. Curve A represents the results from the test on a one-foot diameter by two-feet deep aggregate pier in which the aggregate was not compacted. Curve B represents the results from the test on a one-feet diameter by two-foot deep aggregate pier in which the aggregate was heavily compacted in layers six inches thick. Curve C represents the results from the test on a one-foot diameter by three-feet deep aggregate pier in which the aggregate was heavily compacted in layers to thicknesses of six inches.

The results of these tests indicate that the observed settlements for the short aggregate piers under the design load of 2.5 ksf were substantially less than the specified tolerable settlement of 0.5 inch. Curves B and C are essentially the same, thereby indicating that the depth to diameter ratio or the height to diameter ratio of the short aggregate piers need be no greater than 2.0 to obtain maximum reinforcing effect in the soil. Constructing aggregate piers deeper than this for a given diameter is deemed to be uneconomical because little additional reinforcing effect is obtained with the additional cost associated with the larger pier. Comparison of Curves A and B illustrates the importance of prestressing and densifying the surrounding soil by high-intensity lateral stresses induced during compaction of the aggregate lifts. The compacted aggregate pier (Curve B) settled substantially less than the non-compacted aggregate pier (Curve A) at all applied pressures. For example, at the design pressure of 2.5 ksf, the compacted pier settled at 0.08 inch, 78 percent less than the 0.36 inch settlement for the non-compacted pier. In addition, the compacted aggregate pier remained stable at the maximum applied pressure of 15 ksf, whereas the non-compacted aggregate pier approached failure at an applied pressure of approximately 9 ksf.

In the second field study, two twenty-four-inch diameter field plate-load tests were conducted. Reactions for the loading tests were provided by jacking against a steel beam load frame attached to four helical soil anchors. The first plate-load test was performed on unreinforced in situ soil consisting of firm sandy silt. Dynamic penetrometer blowcounts (per 1.75 inch increment) of the near-surface soil ranged from nine to thirteen and averaged ten. The second plate-load test was conducted on an aggregate pier having a diameter of two feet and a depth of five feet. The initial cavity was four feet deep but was enlarged to a depth of five feet by compacting the soil at the bottom of the cavity using high energy impact compaction from a tamping head as shown at 12 in FIG. 2. High energy impact compaction from the same tamping head were used to compact aggregate in layers eighteen inches thick (except the last or top layer which was compacted to a thickness of twelve inches), while simultaneously applying high intensity lateral stresses to the surrounding soil, which prestressed and densified the soil.

Figure 11:
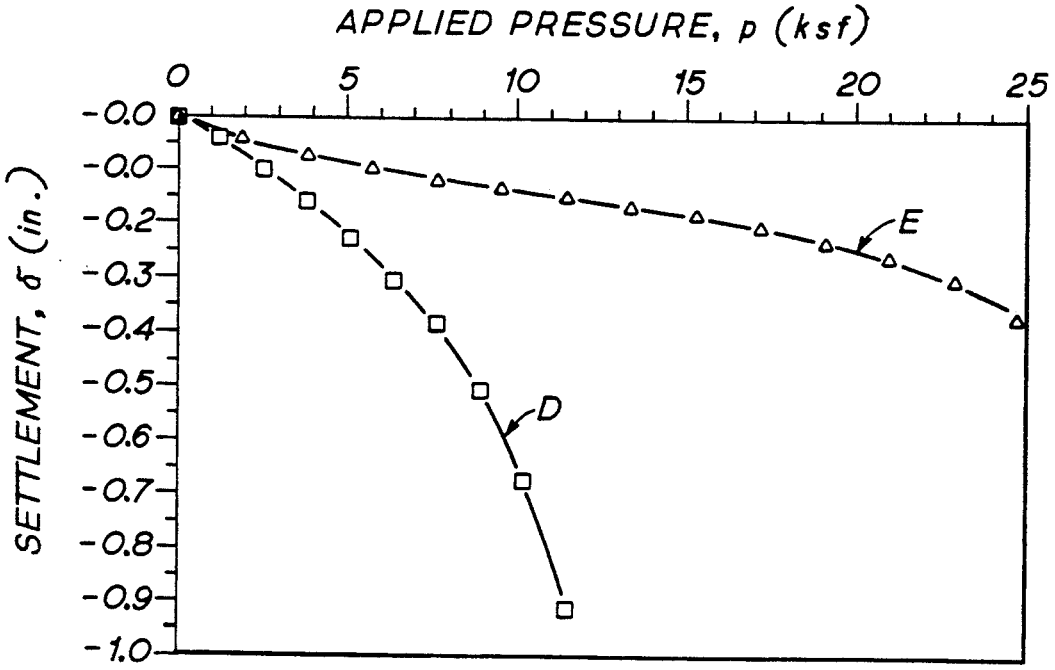

Pressure-settlement curves for these two plate-load tests are given in FIG. 11. Curve D represents the results from the test on the unreinforced soil. Curve E represents the results from the test on the short aggregate pier. Comparison of the two curves illustrates the substantial reinforcing effect provided the short aggregate pier. At all applied pressures the settlement of the short aggregate pier supported by the surrounding soil (Curve E) is substantially less than the settlement of the unreinforced soil (Curve D). For example, at an applied pressure of 10 ksf, the short aggregate pier settled 0.13 inch, 80 percent less than the unreinforced soil which settled 0.64 inch. In addition, the unreinforced soil approached failure at an applied pressure of approximately 11 ksf, whereas the short aggregate pier remained stable at an applied pressure of 25 ksf.

The short aggregate pier can fail to support the required load by rupturing or by sliding relative to the soil surrounding the aggregate pier. In this regard, the interaction between the aggregate pier and the soil surrounding the pier is crucial. For example, the aggregate pier is made up of individual aggregate elements which are not adhered together. This cohesionless pier is prevented from rupturing under load largely by the lateral reaction forces exerted on the pier by the surrounding soil. Thus, the soil's local ability to bear force directly influences the aggregate pier's ability to resist rupturing. By prestressing and densifying the soil laterally adjacent the aggregate pier, the aggregate pier is better able to resist rupturing.

The prestressing and densification of the soil laterally adjacent the short aggregate pier and beneath and adjacent the aggregate pier also tends to increase the load-bearing capacity of the aggregate pier by decreasing the tendency of the pier to slip in shear relative to the prestressed surrounding soil. This is so because the prestressed and densified soil laterally adjacent the aggregate pier tends to exert a tighter "grip" on the aggregate pier. This is analagous to trying to prevent a cylindrical object from slipping through one's hands by grasping the object more tightly. In effect, this is what the prestressed soil does. In addition, densification of the soil beneath the aggregate pier provides a firmer bearing surface for the aggregate pier, thereby further increasing the ability of the aggregate pier to support the required load.

Another way in which the tendency of the short aggregate pier to slip in shear relative to the soil is diminished by the present invention is the shape of the interface between the aggregate pier and the soil laterally surrounding the pier. The aggregate pier has a series of bulges extending along the length of the pier and the prestressed and densified soil has a complementary shape. This shape exhibits a greater surface area than a conventional deep cylindrical stone column. Also, the bulges in the short aggregate pier act like shallow anchors dug into the compacted soil. For example, the prestressed and densified soil in the vicinity of the node indicated at 49 in FIG. 5 resists the movement of lift 53 downwardly therepast with compressive forces, in addition to the shear forces. This significantly enhances the resistance of the short aggregate pier to slip relative to the surrounding soil.

SECOND PREFERRED EMBODIMENT

Figure 7:
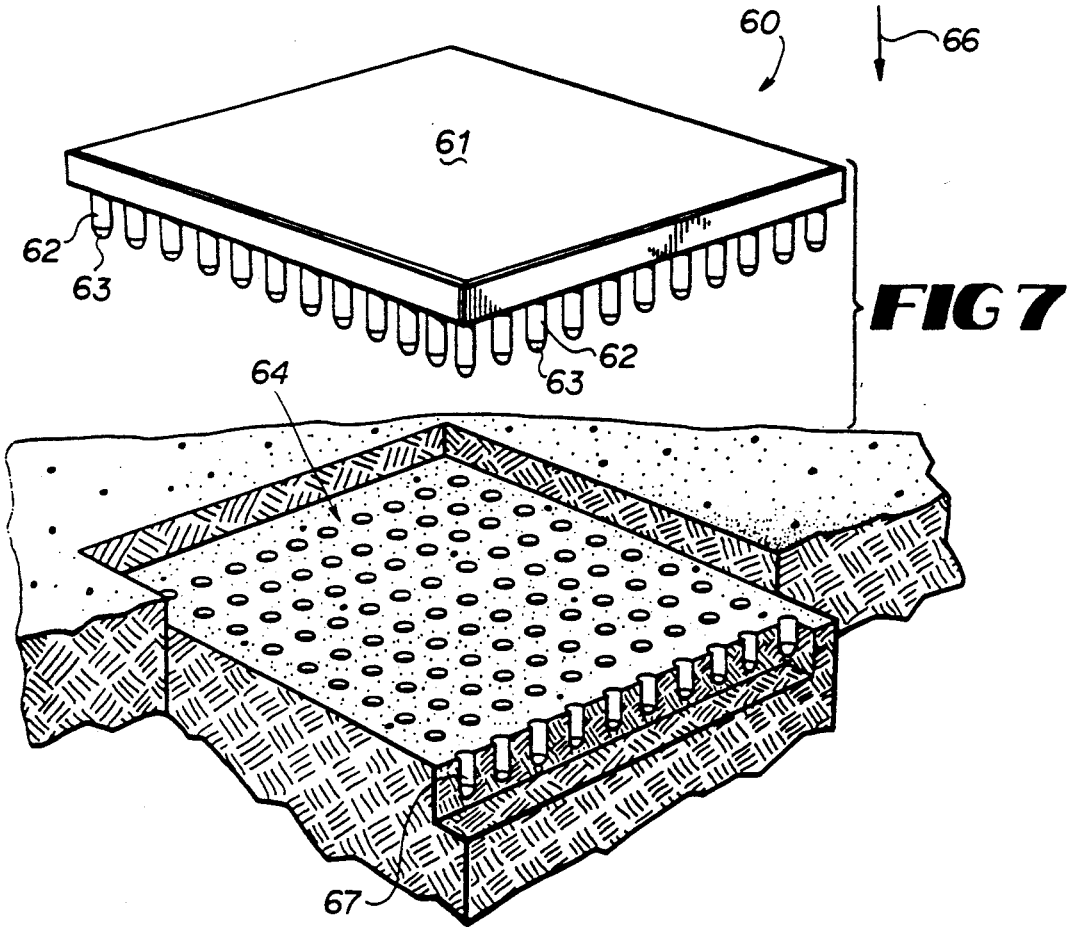
FIG. 7 is a schematic, partially cut-away, perspective illustration of a method and apparatus according to a second preferred form of the invention in which a large number of small aggregate piers are constructed simultaneously.
Figure 8:
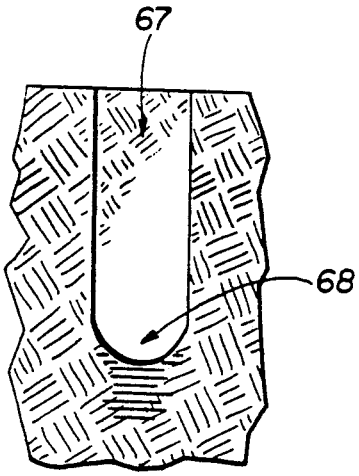
FIG. 8 is a side sectional illustration of a cavity created in accordance with the method and apparatus of FIG. 7.
Figure 9:
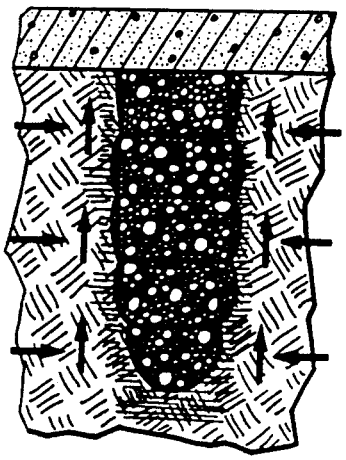
FIG. 9 is a side sectional illustration of a short aggregate pier constructed in situ in the ground in accordance with the method and apparatus of FIG. 7.

FIGS. 7–9 show a second preferred form of the invention. In this embodiment, a method and apparatus is provided which is intended, for example, for improving inadequate soils so that the soils can receive and support a layer of pavement. According to the method and apparatus, a tamping head indicated generally at 60 includes a platen 61 bearing a large number of individual probe elements for pricking the ground, such a probe element 62. The probe elements are arranged in a grid pattern and are each generally cylindrical with a rounded portion indicated at 63. Each of the rigid probe elements has a diameter of preferably two inches and a length of six inches, the probe element, however, can be constructed to have diameters of between of one-half inch and six inches, and lengths between one and twenty-four inches.

The tamping head 60 is attached to an unshown means for moving a tamping head up and down, as is well known in the art. In use, the tamping head is moved downwardly in the direction of direction arrows 66 to form a grid of cavities in unreinforced soil, as shown in the lower portion of FIG. 7. The grid 64 of cavities is made up of a large number of individual cavities, such as cavity 67 shown in FIG. 8. Each of the cavities is generally cylindrical with a beveled or rounded bottom portion 68.

In use, the tamping head 60 is operated in a manner analagous to that of tamping head 12. Specifically, the tamping is moved downwardly to form the grid of cavities 64 and then is withdrawn. The cavities are then partially filled with loose granular material and then the tamping head is lowered to reintroduce the individual probe elements into the cavities to compact the loose granular material in the cavities. The rounded tips of the probe elements compact the loose granular material both vertically and laterally, thereby bulging the cavity in the vicinity of the layer of granular material. As in the prior embodiment, probe element 62 can define a frusto-conical lower surface, similar to surface 24, rather than defining a rounded portion 63. The tamping head is then withdrawn and an additional layer of loose granular material is added and the compacting is repeated. The addition of loose granular material and the compaction of the loose granular material into successive layers is repeated until the cavity is filled substantially completely with compacted granular material. In this way, a small-scale aggregate pier results in each of the cavities, with each pier having the undulated, bulging shape similar to that shown in FIG. 9.

Optimum spacing of the probe elements is approximately four times the probe diameters but may vary from as low as two times the probe diameter to as great six times the probe diameter. Preferably, the grid includes sixty-four (64) probe elements, but may contain as few as four probe elements.

The resulting grid of small-scale aggregate piers greatly increases the load-bearing capability of the soil, thereby making it suitable for roadway pavement support. The effectiveness of this method and apparatus was confirmed in a series of laboratory tests of the type known as California Bearing Ratio (CBR) tests. In these CBR tests, a grid of small-scale aggregate piers was constructed in CBR samples simulating bearing soils for on-grade construction. In these tests, soil was stabilized to form a soil/pier matrix in which the soil comprised soft clay stabilized with one-half inch diameter, two-inch long piers constructed of well-graded sand, with the number of piers varying from one to thirteen.

For these tests on the clay matrix, the increase in CBR ranged from 33% to 145% for eight tests, with no improvement for one sample of saturated clay reinforced with only one column. Although these sand elements were not highly compacted and did not induce high intensity passive pressures in the soil matrix, it is apparent that measurable improvements were achieved. The CBR values generally increased with increasing numbers of columns within the sample. The results from these laboratory tests demonstrated that a grid of small-scale granular element columns can be used to reinforce, stabilize, and improve matrix soils for on-grade construction.

While the invention has been disclosed in preferred forms, it will be apparent to those skilled in the art that many modifications, additions and deletions may be made therein without departing from the spirit and scope of the invention as set forth in the appended claims.

We claim:

1. A method for producing short aggregate piers in situ in the ground comprising the steps of:

(a) forming a cavity in the ground so that the ground soil forms the bottom and side walls defining the cavity;

(b) compacting soil in the vicinity of a bottom portion of the cavity to prestress and densify the soil in the vicinity of the bottom;

(c) adding a layer of loose aggregate to the cavity so that the aggregates contact portions of the lateral surrounding soil of the side walls defining the cavity and also form an upper surface;

(d) inserting a tamping tool into the cavity so that the tamping tool engages said upper surface;

(e) reciprocating said tamping tool for successively engaging said upper surface for compacting the layer of aggregate to reduce the height of the layer and force some of the aggregate laterally into the side walls defining the cavity for laterally enlarging the cavity in the vicinity of the layer and for prestressing and densifying the laterally surrounding soil;

(f) removing the tamping tool from the cavity; and (g) repeating steps (c), (d), (e), and (f) until the cavity is filled substantially completely with compacted aggregate.

2. A method as claimed in claim 1 wherein the steps of forming a cavity in the ground and compacting soil in the vicinity of a bottom portion of the cavity is performed by driving a tamper into the ground to form the cavity and compact the soil.

3. A method as claimed in claim 1 wherein the step of compacting a layer of aggregate with a tool is carried out with an tool having a tapered portion adapted to force some of the aggregate laterally into the side walls of the cavity.

4. A method as claimed in claim 1 wherein step (c) includes providing well-graded stone for forming said loose aggregate.

5. A method as claimed in claim 4 wherein the well-graded stone is added to a height of approximately 18 inches.

6. A method as claimed in claim 5 wherein the step of reciprocating the tamping tool includes continuing the tamping for a sufficient length of time to the height of the layer to roughly twelve (12) inches.

7. A method as claimed in claim 1 wherein the the step of reciprocating the tamping tools is continued until the height of the layer is reduced by approximately one third its original height.

8. A method as claimed in claim 1 wherein the tool used for compacting the layer of loose aggregate has a frusto-conical portion adapted to force some of the aggregate laterally.

9. A method as claimed in claim 1 wherein the cavity formed in the ground according to step (a) has a length to diameter ratio of between 2.0 and 3.0.

10. A method as claimed in claim 1 wherein the cavity formed in the ground according to step (a) is between 3 and 10 feet deep.

11. A method as claimed in claim 1 wherein the cavity formed in the ground according to step (a) is between 5 and 6 feet deep.

* * * * *